US005862537A

United States Patent [19]

Osmond

[11] Patent Number: 5,862,537

[45] Date of Patent: Jan. 26, 1999

[54] FLUSH LEVER OPERATED RESERVOIR TOILET TANK CONTROL

[76] Inventor: John S. Osmond, 2525 14th St., Santa Monica, Calif. 90405

[21] Appl. No.: 917,164

[22] Filed: Aug. 25, 1997

Related U.S. Application Data

[63] Continuation of Ser. No. 565,323, Nov. 30, 1995, abandoned.

[51] Int. Cl.[6] ..... E03D 1/33

[52] U.S. Cl. ..... 4/363; 4/366; 4/415

[58] Field of Search ..... 4/333, 338, 339, 4/345, 346, 363, 365, 366, 368, 372, 377, 415

[56] References Cited

U.S. PATENT DOCUMENTS

| | | | |
|---|---|---|---|
| 755,166 | 3/1904 | Phillips | 4/363 |
| 840,613 | 1/1907 | Findeisen | 4/346 |
| 3,574,867 | 4/1971 | Biniores | 4/363 |
| 4,114,203 | 9/1978 | Carolan | 4/372 X |
| 4,993,086 | 2/1991 | Palmer | 4/363 |

*Primary Examiner*—Robert M. Fetsuga
*Attorney, Agent, or Firm*—William H. Maxwell

[57] ABSTRACT

A flush lever operated control reservoir and toilet flush system for toilet water storage tanks, for preventing continued flow from a water supply as a result of a flush valve leak or a tank leak, the fill valve is responsive to a water level in a separate reservoir filled by a flood level of storage tank water to shut OFF the fill valve, a drain in the form of a syphon from the reservoir is responsive to operation of a flush handle to empty the reservoir to turn ON said fill valve and simultaneously discharge the storage tank, and a flood preventor refilling the reservoir in the event of a system failure.

26 Claims, 5 Drawing Sheets

3
Y
22
19
A
27
29
23
51
50
S
34
37
52
30
b
55
33
17
20
28
32
12
R
16
45
36
46
21
3
X
19
15
11
26
18
24
T
13
14
25

FLUSH LEVER OPERATED RESERVOIR TOILET TANK CONTROL

This application is a continuation of application Ser. No. 08/565,323 filed Nov. 30, 1995, abandoned.

BACKGROUND OF THE INVENTION

This invention relates to a water closet or toilet which is conventional in every respect except for the fill valve control that prevents any continued flow of water from the storage tank. A characteristic feature of this invention is the provision of a reservoir in which the water level responsive fill valve operates independent from the water storage tank water level. Accordingly, a conventional toilet bowl and trap (not shown) supports a conventional storage tank equipped with the usual overflow pipe and flush valve unit heretofore referred to as the "Douglas valve", and the usual level control means heretofore referred to as the "ball-cock". The level control means restores the storage tank water to a ready to flush level after each flushing, and the flush valve releases the stored water at a rapid rate for flushing the toilet bowl. State of the art level control fill valve units and flush units are shown herein, it beings understood that there is a wide variety of such valves as they are supplied as replaceable units.

It is a general object of this invention to prevent storage tank leakage when the flush valve unit deteriorates and water flow cannot be stopped thereby. However, the fill valve level control means is far more reliable and its failure, if at all, is taken care of by the overflow pipe of the flush valve unit. In practice, deterioration of the flush valve results in gradually increased leakage which lowers the water level in the storage tank, or sudden breakage can occur, and with a conventional installation this wasteful failure is automatically compensated for by the level responsive fill valve unit which continuously discharges water into the storage tank. It is this automatic wasteful compensation that is eliminated by this invention, in that no water can be continuously discharged into and drained from the storage tank. A one-time-only discharge of a full tank of water can occur, this reservoir fill valve control preventing any further drainage from the storage tank which then remains dry until repair is made.

It is an object of this invention to isolate the fill valve from the storage tank and make it responsive to a separate water level that changes according to the normal flushing cycle of the toilet and not affected by a leaking flush valve or flush valve failure that results in an empty storage tank.

It is an object of this invention to provide a control reservoir with a fill means and a reservoir drain means whereby 1) storage tank water fills said reservoir so that the fill valve shuts OFF the water supply and maintains a FULL level thereof in both the reservoir and the storage tank, and 2) reservoir water discharges upon manual operation of the flush valve handle when flushing the storage tank water, so that the fill valve opens to refill the storage tank and reservoir. In the passive ready-to-flush condition the storage tank and control reservoir have a common water level, the reservoir having been filled by overflow water from the storage tank. In and during the flush condition the reservoir drain means is operated to deplete the water level in the reservoir for response by the fill valve to discharge supply water into the. storage tank. At the end of the fill condition the high level of storage tank water overflows into the control reservoir to raise the water level therein and shut OFF the fill valve. And, in the event of a leaking storage tank or flush valve failure the control reservoir water level remains high so that the fill valve is shut OFF. In its preferred form, the reservoir drain means is a syphon that is submerged in the control reservoir and fully primed and dormant when the flushing system is in the passive condition, syphoning of the control reservoir being simultaneously initiated with opening of the flush valve during a normal flushing operation.

Another object of this invention is to provide a restart means for the flushing system. For example, if the storage tank is empty and the control reservoir full, the fill valve will be shut OFF. In order to fill the storage tank in a normal manner, I have provided the reservoir drain means, preferably a syphon with a movable leg that discharges the control reservoir so that the fill valve responds to turn ON the water supply to the storage tank. The movable leg of the syphon is operated manually by the toilet flush handle.

Still another object of this invention is to provide for inherent filling of the control reservoir in the event of a catastrophic failure in the flushing system. For example, the storage tank may be rendered incapable of filling, in which case the conventional fill valve would normally remain open or ON. However, the conventional "refill tube" of the fill valve is employed herein to discharge into said control reservoir and is metered to fill the same within a determined short length of time. There are flush toilets wherein the fill valve inherently refills the toilet bowl and trap with seal water so as to prevent escape of gas from the sewer system. And there are flush toilets wherein the aforesaid "refill tube" is required by Code to ensure refill of the toilet bowl trap. And also, there are flush toilets wherein the toilet bowl trap is inherently refilled with seal water, with no Code requirement for the trap refill tube function. Accordingly, there are flush toilets wherein the "refill tube" function is redundant and therefore unnecessary.

Since the "refill tube" is a feature present in many conventional fill valve units, it and its function is advantageously employed to ensure refilling of the control reservoir R as disclosed herein. In practice, the refill tube can simultaneously refill both the control reservoir and the toilet bowl trap.

SUMMARY OF THE INVENTION

This Flush Lever Operated Reservoir Toilet Tank Control implements a flush valve so that continued water waste cannot occur. Any type flush valve can be employed, the only requirements therefor being its capability to be manually opened and then closed when the flushing condition is completed. And, any type fill valve can be employed (hydraulic, pneumatic, or float controlled), the only requirements being its capability of turning ON when the control reservoir water level drops and of shutting OFF when the control reservoir water level rises to its normal height limit. In accordance with this invention there is a control reservoir combined with the fill valve, and characterized by fill means that charges said reservoir with storage tank water until the water level is common to both the storage tank and to the reservoir, and by a reservoir drain means operated simultaneously with the flushing operation. In the event of a catastrophic failure of the flush valve or of the storage tank, means is provided to fill the reservoir in a short length of time-so as to shut OFF the fill valve. Initial operation or following repair, start or restart of this flushing system is by manual operation of the toilet flush handle that releases water from the control reservoir through operation of the reservoir drain means, preferably in the form of the syphon.

In practice, the control reservoir and syphon are combined with the fill valve.as a unit.

The foregoing and various other objects and features of this invention will be apparent and fully understood from the following detailed description of the typical preferred forms and applications thereof, throughout which description reference is made to the accompanying drawings.

THE DRAWINGS

FIG. 1. is a plan view of a typical storage tank arrangment, illustrating a manually operated flush valve unit, and a fill valve unit combined with the Flush Lever Operated Reservoir Toilet Tank Control of the present invention.

Figure 9:
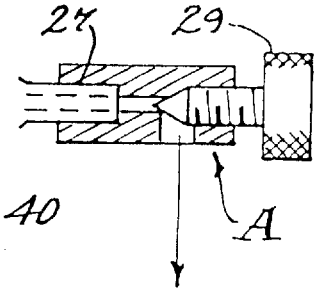

And, FIG. 9 is an enlarged detailed sectional view of the reservoir refill adjuster.

PREFERRED EMBODIMENT

The toilet under consideration is comprised of a floor mounted toilet bowl (not shown) and a raised water storage tank T. The bowl includes a flush ring and waste trap, and a cover and seat. The storage tank T is supported by the bowl and forms a back, and flushing is by gravity flow of water from the storage tank and through the flush ring and waste trap.

The toilet is made operational by a flush means X and a fill means Y, which are individually operable to perform their functions. These two valve units are arranged as shown, the flush means X unit being centered in the storage tank T to discharge into the back of the toilet bowl, and the fill means Y unit being offset to one side (left side) and clear of the flush valve.

The flush means X, involves a floatable ball or flap valve 10 adapted to be lifted from a seat 11 at the foot of an overflow pipe 12 that extends above a "full" water level in the storage tank. T and open to atmosphere below said seat. The foot of the flush means X is sealed to the bottom 18 of the storage tank T and secured by a ring 13 threaded onto a discharge pipe 14. The flap valve 10 is pivoted on the overflow pipe at 15 and is connected by a lift link 16 to a lever 17 that is manually operable from the exterior of the storage tank (see FIG.1). The flap valve 10 is bouyant and remains open until the storage tank water subsides.

The fill means Y unit involves a water shut OFF valve 19 actuated by a water level responsive means. As shown herein the water level responsive means is a float 20 freely slidable over a standpipe 21 and connected to a valve actuating lever by means of a push-pull rod so as to shut OFF the water supply when the float 20 is at a FULL water level, as later described, and to turn ON the water supply when the float 20 drops in response to a subsiding water level. The foot of the standpipe 21 is sealed to the bottom 18 of the storage tank T and is secured by a nut 24 threaded over a water supply pipe 25. The standpipe 21 is comprised of an inside and an outside tube, whereby supply water flows upwardly to the valve 19 via the inside tube and water is discharged via an annulus to ports 26 at the foot of the standpipe. A refill means A discharges a restricted flow of water for automatically ensuring refill of a control reservoir R. The float 20 to lever 22 connection is set by an adjuster 28.

Referring now to the float valve reservoir with flush lever operated drain means and simultaneous storage tank flush control, a control reservoir R and its associated means are combined with the fill means Y unit, as clearly shown throughout the drawings. A feature of this invention is the isolation of the reservoir water from the storage water, and the distinctive water shut OFF level at the brim 30 of the control reservoir R for holding a FULL water level in the storage tank T. It will be observed that the control reservoir R is a small volume upwardly open vessel that accomodates the float 20, and that its brim 30 is at the FULL level and immediately below the FLOOD level of the system.

The reservoir drain means can vary in form, providing that it functions to empty the control reservoir R simultaneously with flushing of the storage tank T. Accordingly, the reservoir drain means and flush means X are simultaneously operated by the flush handle 51, for emptying the control reservoir R when flushing occurs. In its preferred form the reservoir drain means is a syphon means S with its bridge 33 substantially below said FLOOD level. An equivalent reservoir drain means is a reservoir drain valve (not shown) operated by the flush handle 51 that simultaneously operates the flush means X.

In accordance with this invention a manually positionable discharge channel 34 leg of the syphon means S permits storage tank T water to flood over the brim 30 and into the control reservoir R when the level of storage tank water reaches and exceeds the FULL level and then reaches the FLOOD level. However, it is to be understood that this occurrence does not in itself shut OFF the water supply 25, since the control reservoir R is empty after each flushing operation, which leaves the float 20 positioned to turn ON the water valve 19. In practice, flooding of the control reservoir raises the water level to the brim 30 of the control reservoir as is permitted by inflow of storage water over the brim 30 and into the said reservoir. Inflow into the control reservoir occurs only when the storage tank T water level exceeds the flood level over the brim 30. Outflow from the control reservoir normally occurs only when the discharge leg 34 of the syphon means S is lowered. And with the discharge leg 34 in its raised position, the water level in the control reservoir can only recede to the bridge 33 in the event of a leaking seal 41 (later described), in which case the float 20 responds to close the fill valve 19.

Figure 4:
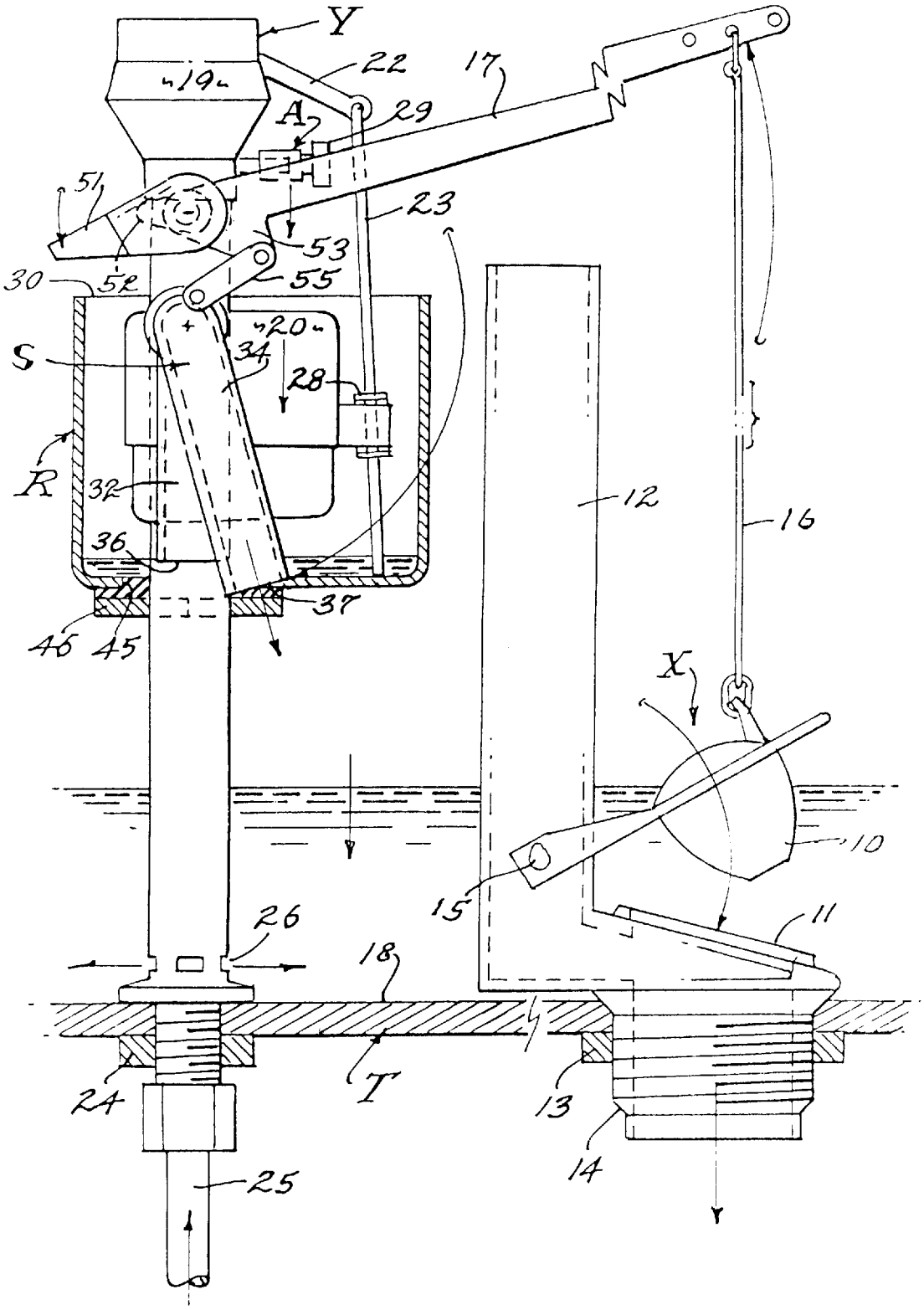
FIG. 4 is a view similar to FIG. 2, illustrating the flush condition.
Figure 5:
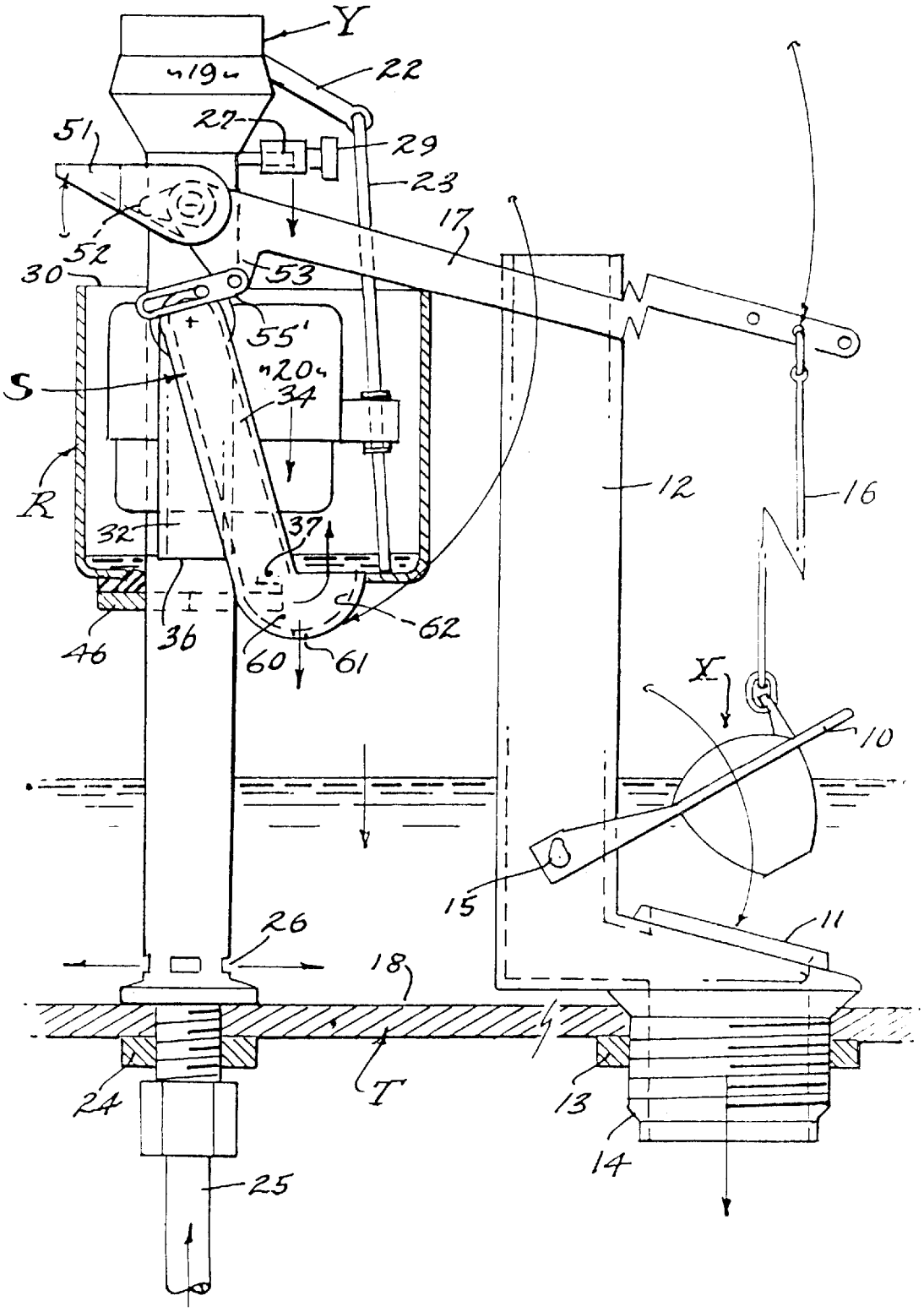
FIG. 5 is a second embodiment view similar to FIGS. 2 and 4, illustrating an incomplete flush condition wherein the flush handle and flush lever have been quickly released and the syphon drain means is functional.

The outflow control syphon means S discharges the water held in control reservoir R when the toilet flushing operation occurs. The syphon means involves an inside suction leg 32 from the inside of the control reservoir, joined over the bridge 33 to an outside discharge leg 34 at the exterior of the control reservoir. A feature of this invention is that the control reservoir is completely submerged in the storage tank water in the FULL passive ready-to-flush level condition, and accordingly the syphon means S is fully primed. The suction leg 32 has an opening 36 immediately above the bottom of the control reservoir R, and the movable channel leg 34 opening 37 is below the opening 36 of the inside suction leg 32 when said movable channel leg 34 is in a down position as shown in FIGS. 4 and 5.

A feature of this invention is the transfer passage 35 over the bridge 33, that is primed in the passive condition. It is to be observed that the transfer passage of the syphon is dormant when submerged, and that the control reservoir cannot syphon over the bridge 33 under this condition whether or not the movable outside control leg 34 is raised or lowered.

The refill means A that conventionally ensures refilling of the toilet flush bowl trap is provided by the fill valve unit in the form of a spigot 27 that discharges a restricted flow of refill water and part or all of which can be discharged into the reservoir R after each flushing, so as to fill the control reservoir R to the FULL level for water shut OFF. The toilet bowl trap does not require refilling in the flush toilet as herein disclosed.

In the event of a total system failure, such as breaking a flush valve or having it hang open, the means A is provided for refilling the control reservoir R within a short time, so that that continued discharge of the system cannot occur. The conventional refill means or spigot 27 is advantageously employed for this pourpose its discharge being directed into the control reservoir R. A usual fill valve Y refills a storage tank T within 45 to 50 seconds, and the discharge rate of a state of the art refill tube 27 will refill the entire control reservoir R within two or three minutes. However, variations in water pressure will change the refill rate, in which case a variable flow control means in the form of a needle valve 29 is provided to shut down the flow from spigot 27 (See FIG. 9). Accordingly, in case of a catastrophic event when flooding occurs, the flood preventer means refills the control reservoir within an adjusted short time so that the water valve 19 is shut OFF.

Figure 2:
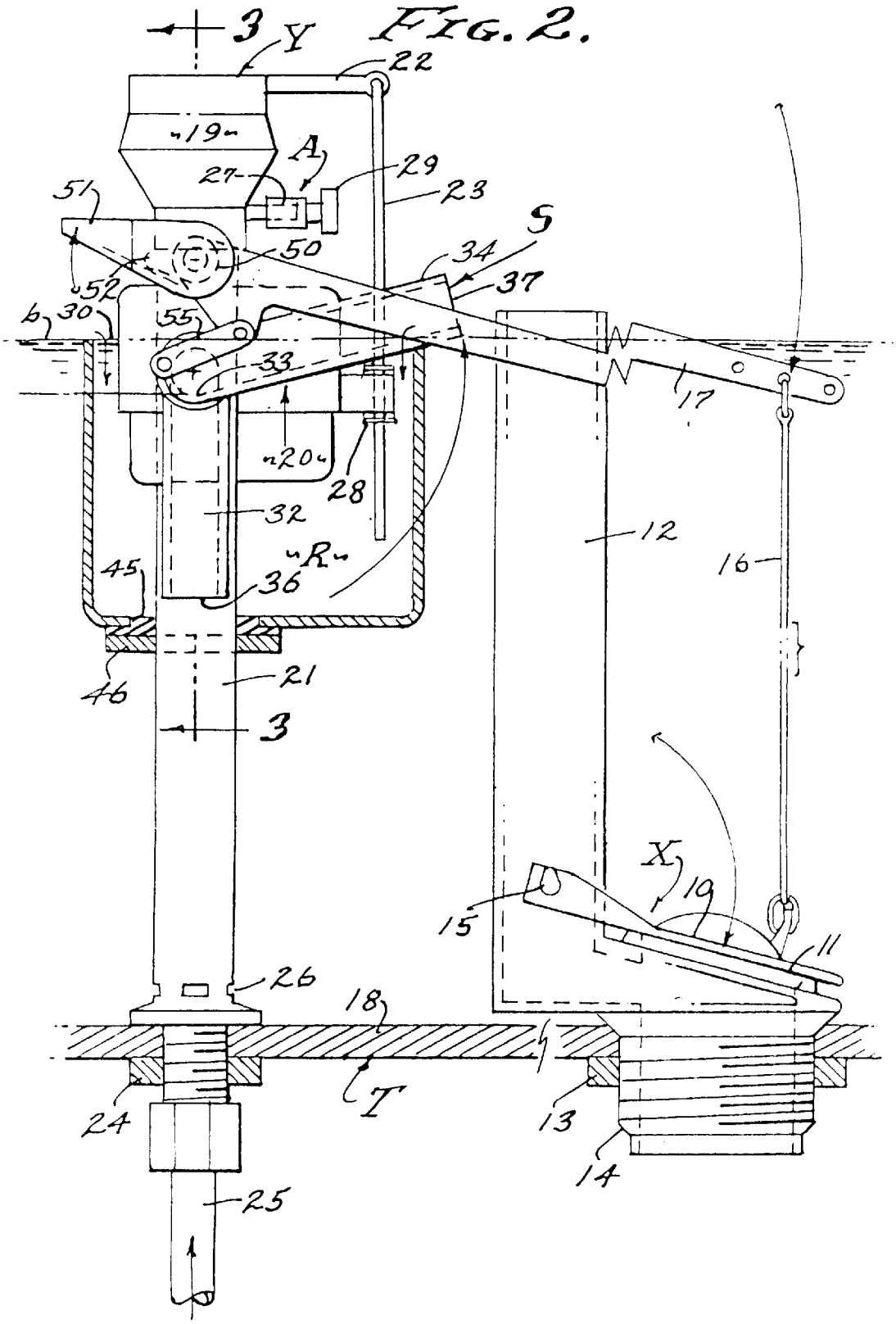
FIG. 2 is a detailed sectional view taken as indicated by line 2—2 on FIG. 1, illustrating the preferred syphon drain means in the passive ready-to-flush level condition.

In accordance with this invention, the toilet can be flushed or an empty storage tank can be refilled for flushing at any time, by simply emptying the control reservoir to open the water refill valve 19. In its preferred form the syphon means S has a fixed intake channel leg 32 in and extending to an opening 36 at the bottom of the control reservoir R, and a movable discharge channel leg 34 adapted to be depressed with its opening 37 end below the inlet of said channel leg 32 and opening at the exterior of the control reservoir. The intake suction leg or channel 32 has an uppermost transfer passage 35 that lies below the brim 30 of the reservoir R. the inner channel leg and outer channel leg being separated so that the outer leg in movable beween an UP position as shown in FIG.2 and a DOWN position as shown in FIG. 4. In practice, the outer discharge channel leg 34 swings through a 90° arc, with its open end 37 above the flood level when in an UP position. The movable discharge channel leg 34 is a free swinging leg rotatably carried on a rod 38 cantilevered from the inner channel 32 coaxially within the transfer passage 35. A head 39 at the outer end of the rod 38 positions the discharge channel leg 34, while a snap-ring 40 at the inner end of the rod 38 positions the intake channel leg 32. The two channel legs have opposed faces between which a seal 41 is supported on a concentric shoulder, and slightly compressed for sealed engagement.

Figure 1:
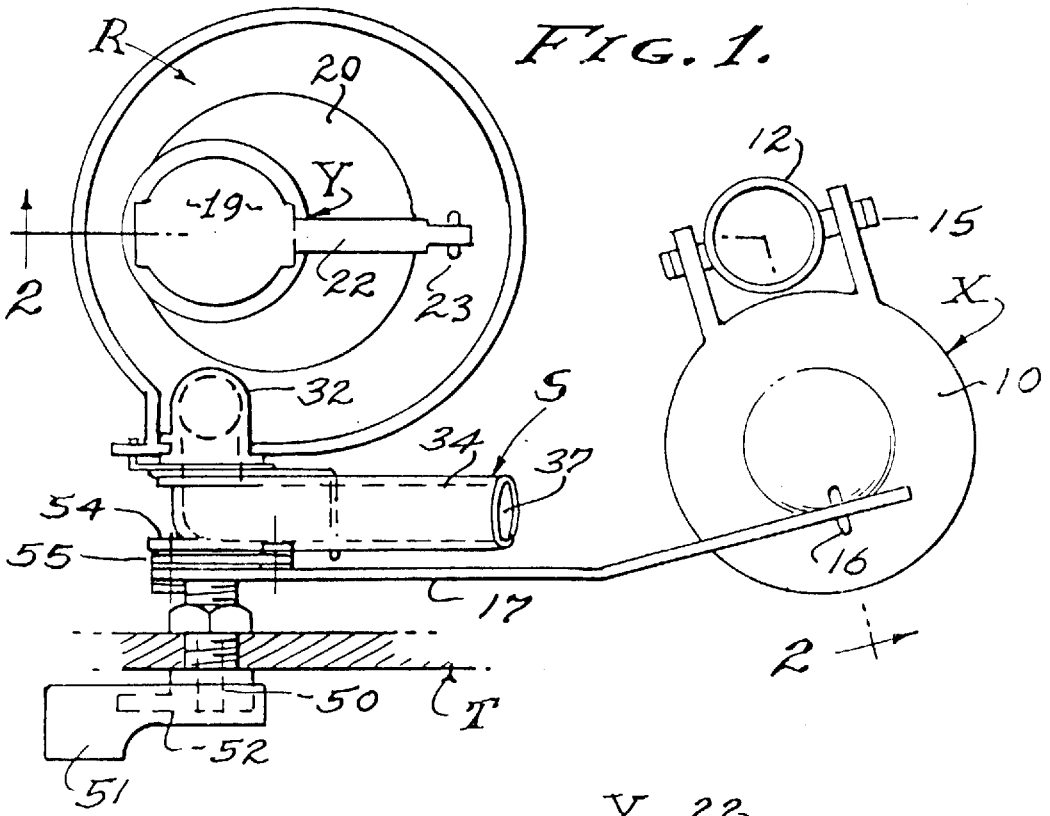
Figure 3:
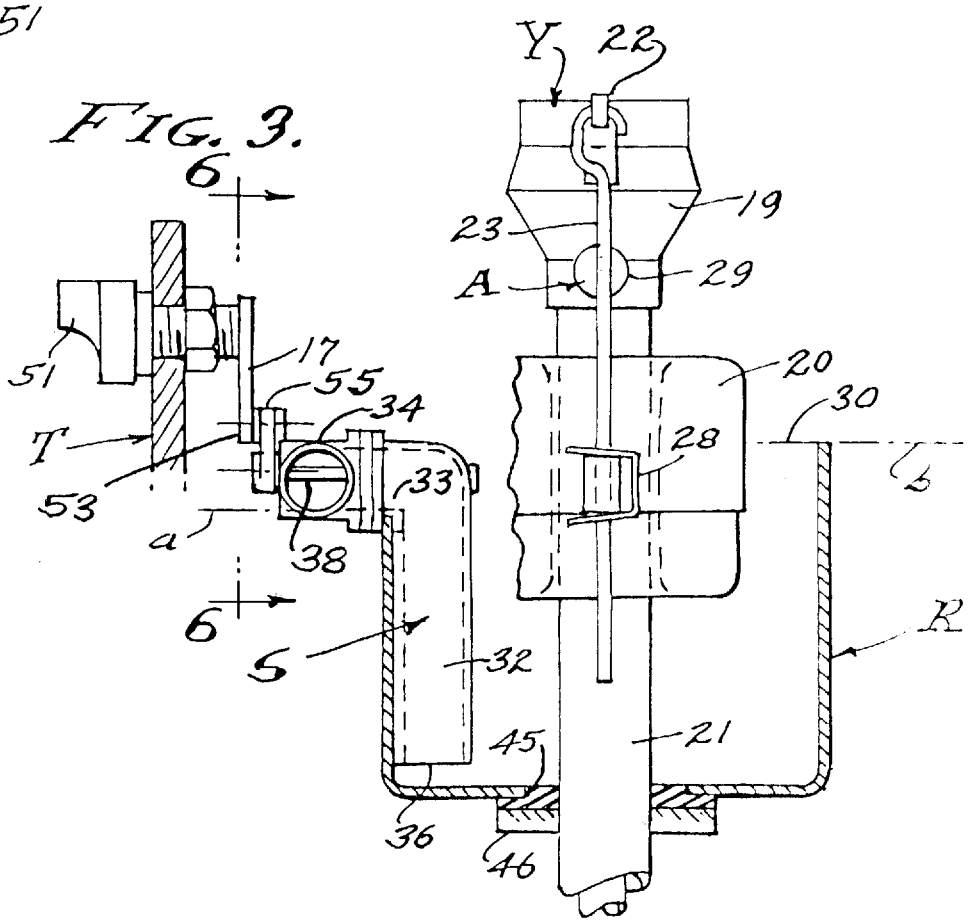
FIG. 3 is a detailed sectional view taken as indicated by line 3—3 on FIG. 2.
Figure 6:
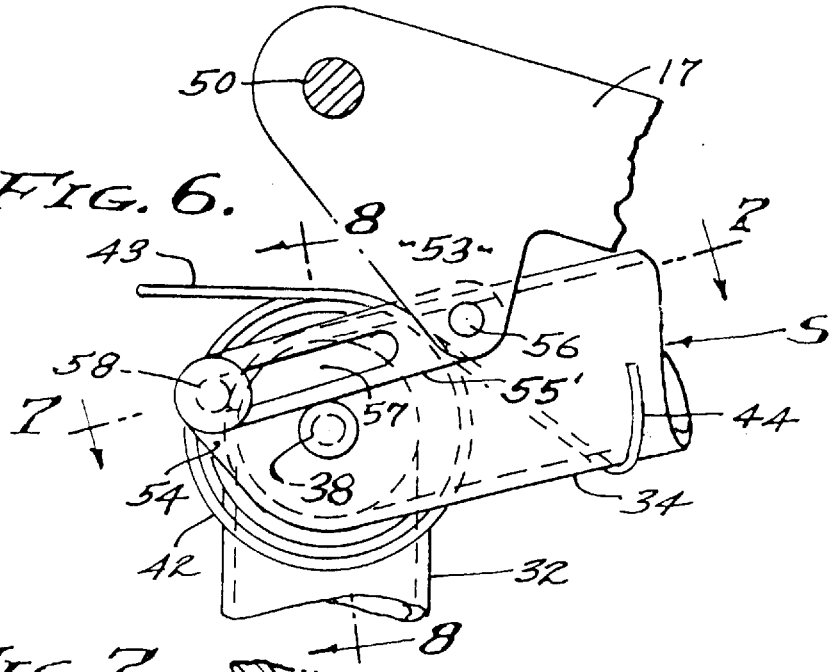
FIG. 6 is an enlarged detailed fragmentary view illustrating the lost motion mechanism of the second embodiment, as it appears in FIG. 5.

Referring now to FIGS. 1 through 4 of the drawings, operation of the syphon means S is shown. FIG. 1 shows the lift link 16 connected to the lever 17 extending from an operating shaft 50 that is manually rotated approximately 30° by a depressible handle 51. Motion of the handle is limited by a stop 52 (see FIGS. 2 and 4). The lever 17 has a pull lever section 53 on a radius from shaft 50, said lever being rotatable approximately 30° between the positions shown in FIGS. 2 and 4. As shown in FIGS. 3 and 6, the rotational axis of shaft 50 is above the pivot rod 38 on which the discharge channel leg 34 swings through an arc of 90°, and said leg has a lever 54 that moves through an arc of 90° between the positions shown in FIGS. 2 and 4. The lever 54 is integral with the outer channel leg 34, the radii of the lever being proportioned to establish the movements desired and as shown.

Figure 7:
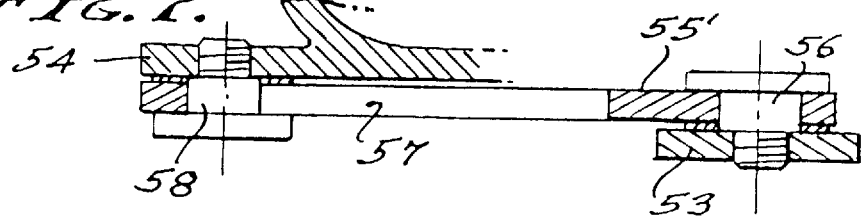
FIG. 7 is a sectional view taken as indicated by line 7—7 on FIG. 6.
Figure 8:
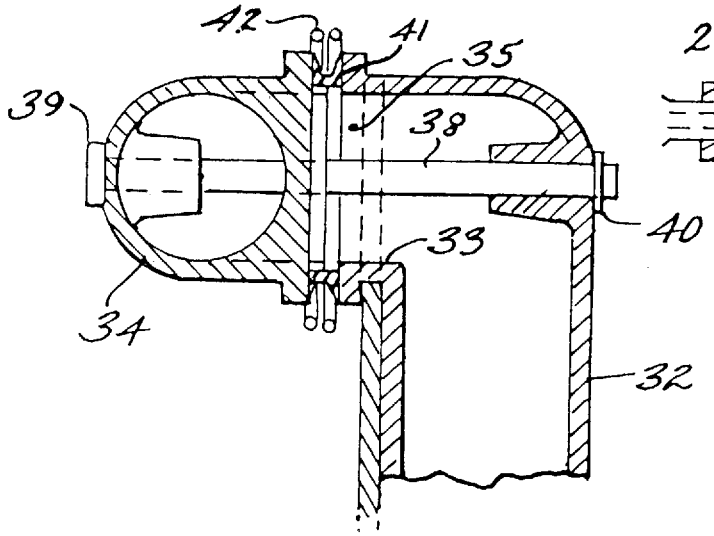
FIG. 8 is a sectional view taken as indicated by line 8—8 on FIG. 6.

The levers 53 and 54 have spaced sides between which a link 55 is disposed to transfer the motion of the pull lever 53 to the syphon lever 54. The lever motion can be direct and positive by means of link 55 of fixed length between its pulling pins as shown in FIGS. 1 through 4. However, a second embodiment with a delayed return of lever 54 may be preferred as shown in FIGS. 5–7, in which case the pull lever 53 can be returned to its passive position as shown in FIG. 5, while the discharge channel leg 34 remains in a depressed position so as to ensure complete reservoir discharge. For said delayed lever action, a link 55' is coupled by a pin 56 to one leg and is provided with a slip joint or slot 57 coupled by a pin 58 to the other leg (see FIG. 5).

In order to implement the aforesaid delayed lever action and to momentarily retain the discharge channel leg 34 in a depressed position for discharge, a balance cup 60 is provided at its terminal open end so as to be filled with discharge water. As shown the cup is level when the discharge channel 34 leg is depressed, there being a bleed hole 61 to time the release of hold-down water. In practice, the bottom 62 of the cup is an arcuate member continuing from the wall of the discharge channel leg 34 recurved downwardly and upwardly approximately 165° as shown in FIG. 5 in order to have a reaction function to hold the discharge channel leg 34 down during water discharge.

A coil spring 42 surrounds the seal 41 and has a first arm 43 anchored into the side of the control reservoir R and a second arm 44 hooked under the discharge channel leg 34 to raise it when the water is drained from the cup 60.

A commercially available fill means unit Y is shown, and to which the control reservoir R and its associated means are retrofitted. The reservoir per se has a bottom opening 45 through which the foot of the standpipe 21 is passed. A split clamp or collar 46 is applied over the standpipe and secured as by means of solvent or adhesive, or by means of fasteners with a gasket (as shown).

United Kingdom requirements are met by employing a syphon flush means devoid of the aforesaid overflow pipe 12, and by. providing a typical United Kingdom "warning pipe" at a specified level above the overflow level or brim 30, whereby leakage into the storage tank can be detected by the warning pipe discharge. The control reservoir and its associated means are the same as hereinabove described.

SYSTEM OPERATION

The passive ready-to-flush water level condition of this flushing system is shown in FIG. 2 wherein the storage tank T is filled to the FULL brim level 30. The flap valve 10 of the flush means X unit is closed and the overflow pipe 12 is vented to atmosphere. The control reservoir R is submerged in the storage tank water and the brim 30 is coincidental with the flood level, the syphon means S being submerged below said flood level. The float 20 rides at the flood level which is common to both the storage tank T and to the control reservoir R, applying closing force to the water valve 19.

Note particularly that the transfer passage 35 is below the flood level and accordingly the system is dormant in a primed condition.

The active flush condition of this toilet flush system is shown in FIG. 4 wherein the storage tank T is in the process of discharging through the seat 11 and discharge pipe 14. The flap valve 10 of the flush means X unit is bouyantly held opened by manually lifting it from the seat 11, and tank water is rushing through the discharge pipe 14. The lowered position of the discharge channel leg 34 initiates and is followed by syphoning of water from the control reservoir.

In practice, the syphon means S drains the control reservoir R at approximately the same rate of fall of water level in the storage tank T, whereby the float 20 drops quickly to turn ON the water valve 19 which immediately commences to refill the storage tank. The flap valve 10 will reseat when the storage tank water drops to the level of seat 11, whereupon the storage tank will be refilled.

An incomplete flush and refill condition of this toilet flushing system is shown in FIG. 5 wherein the flush handle 51 and flush lever 17 have been released to the passive position, while the discharge syphon leg 34 is permitted to continue its function of emptying the control reservoir R for a fully depressed position of float 20 and fully opened position of the water valve 19. The flap valve 10 is open and about to be closed and the two channels 32 and 34 of the syphon means S will drain dry. Accordingly, the water supply pipe 25 is open through ports 26 so as to refill the storage tank over the flood level, whereby storage tank water overflows the brim 30 and into the control reservoir R to prime the channels 32 and 34 and the transfer passage 35 of the syphon means S. Note that the transfer passage is primed with refill water by being completely submerged.

A flush valve failure condition of this toilet flushing system (not shown) can occur wherein a damaged or otherwise ineffective and/or leaking flush valve 10 permits depletion of the water level in storage tank T. Depletion can be slow or fast, and the result of deterioration or mechanical failure. However, the previously empty control reservoir R is automatically refilled from the discharge of the refill tube or spigot 27 so as to immediately raise the float 20 to shut OFF the water valve 19. Accordingly, the control reservoir R and its associated means holds the fill means Y unit in a passive shut OFF condition so that there is no water discharge from ports 26.

A slow to moderate leak of the flush valve will not activate the control reservoir syphon S, because of its separate and independent conditioning. Should the flush valve or storage tank fail totally, the fill means Y will shut OFF quickly according to the adjusted period of time set by the flood preventer means A. Should the toilet system be out of order but capable of flushing, flushing or tank refilling is made possible by manually operating the flush handle 51 in the usual manner.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A flush lever operated control reservoir and toilet flush system for toilet water storage tanks to prevent continued flow of water from a fill means as a result of a leaking toilet flush valve or storage tank of the toilet flush system, the fill means being actuated by a water level responsive means to turn ON and to shut OFF a water supply, and including;

a control reservoir with a brim at a FULL level of storage tank water, a means for filling said reservoir with water until the storage tank is filled up to a required ready-to-flush level, a drain means syphon for discharging water from the control reservoir and having a transfer passage below the brim of the reservoir and between a suction leg within the reservoir and over a bridge to a discharge leg at the exterior of the reservoir, and a flushing means for simultaneously operating the toilet flush valve to discharge the storage tank and positioning the drain means syphon to discharge the control reservoir, the said water level responsive means being responsive to the control reservoir water lever for turning ON the water supply in response to depletion of water from the control reservoir and alternately for shutting OFF the water supply in response to filling of the control reservoir to said FULL level.

2. The lever operated control reservoir and toilet flush system as set forth in claim 1, wherein at least one of said legs is positionable and having a raised dormant position and a lowered active position to activate the syphon.

3. The lever operated control reservoir and toilet flush system as set forth in claim 1, wherein at least one of said legs is positionable and having a dormant raised position opening above the ready-to-flush level and a lowered position to activate the syphon.

4. The lever operated control reservoir and toilet flush system as set forth in claim 1, wherein the discharge leg at the exterior of the reservoir is positionable and has a raised dormant position and a lowered active position to discharge water from the reservoir.

5. The lever operated control reservoir and toilet flush system as set forth in claim 1, wherein the discharge leg at the exterior of the reservoir is postionable and has a dormant raised position opening above the ready-to-flush level and a lowered position opening below the suction leg to discharge water from the reservoir.

6. The lever operated control reservoir and toilet flush system as set forth in claim 1, wherein the flushing means is comprised of a lever connected to lift the toilet flush valve to discharge the storage tank and connected to the drain means syphon to depress a leg of said syphon for discharge of the control reservoir.

7. The lever operated control reservoir and toilet flush system as set forth in claim 1, wherein the flushing means is comprised of a lift lever connected to the toilet flush valve to unseat the said flush valve and connected to the drain means syphon to simultaneously depress a leg of said syphon, there being a flush handle connected to and operating the lever.

8. The lever operated control reservoir and toilet flush system as set forth in claim 1, wherein the flushing means is comprised of a lift lever connected to the toilet flush valve to unseat the said flush valve and connected to the drain means syphon to depress a leg of the said syphon, there being a flush handle connected to the toilet flush valve and to the positionable drain means syphon by operating links for simultaneous operation.

9. The lever operated control reservoir and toilet flush system as set forth in claim 1, wherein the flushing means is comprised of a lift lever connected to the toilet flush valve to unseat the said valve and connected to the drain means syphon to depress a leg of the said syphon, there being a flush handle connected to the toilet flush valve by an operating link and connected to the positionable drain means syphon by a lost motion linkmeans therebetween for separate return of said lift lever.

10. The lever operated control reservoir and toilet flush system as set forth in claim 9, there being a spring means for returning the drain means syphon to a dormant position.

11. The lever operated control reservoir and toilet flush system as set forth in claim 2, wherein the flushing means is comprised of a lift lever with an arm connected to and to unseat the toilet flush valve and with an arm connected to and to operate the discharge leg of the drain means syphon, there being a flush handle connected to and simultaneousy operating the two lever arms.

12. The lever operated control reservoir and toilet flush system as set forth in claim 2, wherein the flushing means is comprised of a lift lever with an arm connected to and to unseat the toilet flush valve and with an arm connected to and to operate the discharge leg of the drain means syphon, there being a flush handle directly connected to the toilet flush valve and simultaneously operating the positionable drain means syphon by means of a link connected thereto.

13. The lever operated control reservoir and toilet flush system as set forth in claim 2, wherein the flushing means is comprised of a lift lever with an arm connected to and to unseat the toilet flush valve and with an arm connected to and to operate the discharge. leg of the drain means syphon, there being a flush handle directly connected to the toilet flush valve and simultaneously operating the positionable drain means syphon by means of a lost motion link means thereto for separate return of the flush valve lift lever to a dormant position.

14. The lever operated control reservoir and toilet flush system as set forth in claim 13, there being spring means for returning the drain means syphon discharge leg to a dormant position.

15. The lever operated control reservoir and toilet flush system as set forth in claim 13, there being an upwardly recurved member at a downward position of the discharge leg of the drain means syphon to have a downward reaction to water discharge to hold the discharge leg in an inactive down position.

16. The lever operated control reservoir and toilet flush system as set forth in claim 13, there being an upwardly open cup with a drain hole at the downward position of the discharge leg of the drain means syphon to capture discharge water for temporarily holding the discharge leg in an active down position.

17. The lever operated control reservoir and toilet flush system as set forth in claim 13, there being an open cup at an open discharge end of the discharge leg of the drain means syphon to capture discharge water and with a drain hole therein for temporarily holding the discharge leg in an active down position, the cup having an upwardly recurved bottom member for reaction to water discharge and to hold the discharge leg in said active down position.

18. The lever operated control reservoir and toilet flush system as set forth in claim 16, there being spring means for returning the discharge leg to its dormant position.

19. The lever operated control reservoir and toilet flush system as set forth in claim 17, there being spring means for returning the discharge leg to its dormant position.

20. A flush lever operated control reservoir and toilet flush system for toilet water storage tanks to prevent continued flow of water from a fill means as a result of a leaking toilet flush valve or storage tank, the fill means being actuated by a water level responsive means to turn ON and to shut OFF a water supply, and including;

a control reservoir with an inflow brim immediately below a FLOOD level of the storage tank, for filling said reservoir with storage tank water when the storage tank is filled over a ready-to-flush level, a drain means syphon for discharging water from the control reservoir and having a transfer passage below the brim of the reservoir and between a suction leg within the reservoir and over a bridge to a discharge leg at the exterior of the reservoir, and flushing means for simultaneously operating the toilet flush valve to discharge the storage tank and operating the drain means syphon to discharge the control reservoir, the said water level responsive means being responsive to the control reservoir water level for turning ON the water supply in response to depletion of water from the control reservoir and alternately for shutting OFF the water supply in response to filling of the control reservoir by inflow of storage tank water over said inflow brim and at the FLOOD level of the storage tank.

21. The lever operated control reservoir and toilet flush system as set forth in claim 20, wherein at least one of said legs is positionable and having a raised dormant position and a lowered active position to activate the drain means syphon.

22. A flush lever operated control reservoir and toilet flush system for toilet water storage tanks to prevent continued flow of water from a fill means as a result of a leaking toilet flush valve or storage tank, the fill means being actuated by a water level responsive means to turn ON a water supply to fill the storage tank,and including;

a control reservoir with a brim at a FULL level below a FLOOD level of the storage tank water, a means for filling said storage tank to said FLOOD level with water until the reservoir is filled to said FULL level required for establishing a ready-to-flush level, a refill means for delivering a restricted flow of water until shut OFF of the water supply by said fill means and discharging into the control reservoir for filling said reservoir to said FULL level for shut OFF, a drain means syphon for discharging water from the control reservoir and having a transfer passage below the brim of the reservoir and between a suction leg within the reservoir and over a bridge to a discharge leg at the exterior of the reservoir, and flushing means for simultaneously operating the toilet flush valve to discharge the storage tank and operating the drain means syphon to discharge the control reservoir, the said water level responsive means being responsive to the control reservoir water level for turning ON the water supply in response to depletion of water from the control reservoir and alternately for shutting OFF the water supply in response to filling of the control reservoir to said ready-to-flush level.

23. The lever operated control reservoir and toilet flush system as set forth in claim 22, wherein the control reservoir brim is immediately below FLOOD level of storage tank water, for filling said reservoir with storage tank water when the storage tank is filled over said ready-to-flush level.

24. The lever operated control reservoir and toilet flush system as set forth in claim 22, wherein at least one of said legs is positionable and having a raised dormant position and a lowered active position to activate the drain means syphon.

25. The lever operated control reservoir and toilet flush system as set forth in claim 22, wherein the control reservoir brim is immediately below FLOOD level of storage tank water for filling said reservoir with storage tank water when the storage tank is filled over said ready-to-flush level, at least one of said legs being positionable and having a raised dormant position and a lowered active position to activate the drain means syphon.

26. A flush lever operated control reservoir and toilet flush system for a toilet water storage tank to prevent continued flow of water from a fill means as a result of a leaking toilet flush valve or storage tank, the fill means being actuated by a water level responsive means to turn ON and to shut OFF a water supply, and including;

a control reservoir with an inflow brim at a full level immediately below a FLOOD level of the storage tank water, for filling said control reservoir to a ready-to-flush level with storage tank water when the storage tank is filled to said FLOOD level, drain means for holding said ready-to-flush level of water in the control reservoir and for discharging water therefrom and into the storage tank, manually operable flushing means for operating the toilet flush valve to discharge the storage tank and for simultaneously operating the drain means to discharge the control reservoir, and refill means for discharging a restricted flow of water into the control reservoir when the fill means is actuated to turn ON for filling said reservoir to said FULL level to shut OFF the water supply, the said water level responsive means being responsive to the control reservoir water level for turning ON the water supply in response to depletion of water from the control reservoir and alternately for shutting OFF the water supply in response to filling of the control reservoir to said ready-to-flush level.

* * * * *